US007604436B2

(12) United States Patent
Byun

(10) Patent No.: US 7,604,436 B2
(45) Date of Patent: Oct. 20, 2009

(54) REPAIR AND REINFORCEMENT SYSTEM OF EXISTING STRUCTURE USING REACTION FORCE OF PRESSURIZING MEANS AND METHOD THEREOF

(75) Inventor: Hang Yong Byun, Gwangju (KR)

(73) Assignee: Soo Gon Lee, Gwangju, Koran ( * ) Notice: Subject to any disclaimer, the term of this patent is extended or adjusted under 35 U.S.C. 154(b) by 688 days.

(21) Appl. No.: 10/552,516

(22) PCT Filed: Feb. 27, 2004

(86) PCT No.: PCT/KR2004/000409

§ 371 (c)(1),
(2), (4) Date: Oct. 6, 2005

(87) PCT Pub. No.: WO2004/090233

PCT Pub. Date: Oct. 21, 2004

(65) Prior Publication Data

US 2006/0191229 A1 Aug. 31, 2006

(30) Foreign Application Priority Data

Apr. 7, 2003 (KR) ..... 10-2003-0021615

(51) Int. Cl.
*E01D 22/00* (2006.01)

(52) U.S. Cl. ..... 405/229; 52/296; 52/297

(58) Field of Classification Search ..... 405/229, 405/230; 52/169.9, 169.13, 292, 296, 297
See application file for complete search history.

(56) References Cited

U.S. PATENT DOCUMENTS

| | | | | |
|---|---|---|---|---|
| 4,478,773 | A * | 10/1984 | Buchler et al. | 264/31 |
| 4,692,981 | A * | 9/1987 | Homes | 29/402.08 |
| 5,154,539 | A * | 10/1992 | McCown et al. | 405/230 |
| 5,205,673 | A * | 4/1993 | Bolin et al. | 405/230 |
| 5,433,556 | A * | 7/1995 | Freeman, III | 405/229 |
| 5,575,591 | A * | 11/1996 | Vanderklaauw | 405/230 |
| 5,800,094 | A * | 9/1998 | Jones | 405/230 |
| 5,980,160 | A * | 11/1999 | Vanderklaauw | 405/230 |
| 6,503,024 | B2 * | 1/2003 | Rupiper | 405/230 |

FOREIGN PATENT DOCUMENTS

KR 10-0214388 8/1999

* cited by examiner

*Primary Examiner*—Frederick L Lagman
(74) *Attorney, Agent, or Firm*—J.C. Patents

(57) ABSTRACT

A system and method of repairing or reinforcing an existing structure using a reaction force of pressurizing means are provided. In a state in which structure supporting means, such as a steel pile, is pressed fit into the ground located under an existing structure to reach a predetermined rigid bearing layer, and the existing structure is lifted by the structure supporting means, a target portion for repair or reinforcement can be repaired or reinforced, irrespective of the construction site or space, without causing any harmful environmental impact.

8 Claims, 9 Drawing Sheets

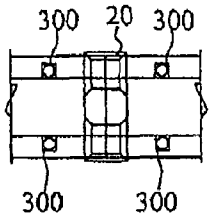
Fig. 4b
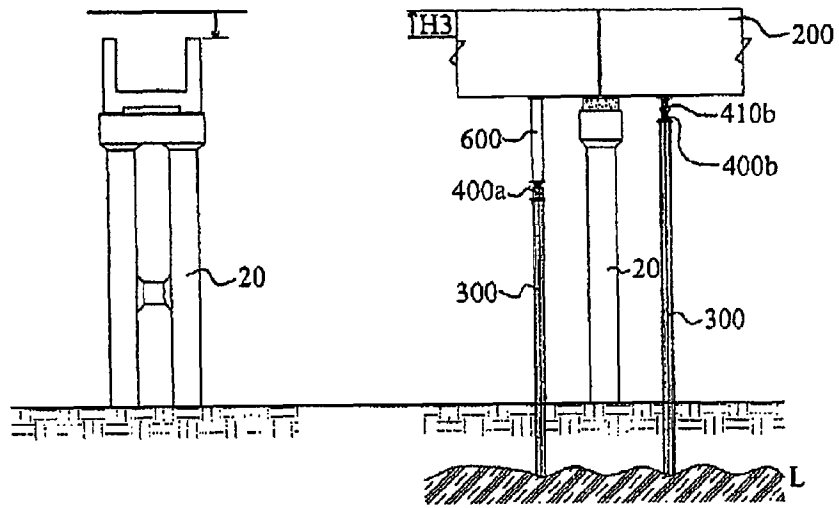
Fig. 4c
Fig. 4a(Prior Art)

REPAIR AND REINFORCEMENT SYSTEM OF EXISTING STRUCTURE USING REACTION FORCE OF PRESSURIZING MEANS AND METHOD THEREOF

TECHNICAL FIELD

The present invention relates to a system and method of repairing or reinforcing an existing structure using a reaction force of pressurizing means. More particularly, the present invention relates to a system and method of easily performing a necessary repair or reinforcement work on an existing structure in a state in which reinforcing means is pressed fit into the ground and the existing structure is lifted using a minimum number of equipments without adversely affecting the existing structure, in a case where although conventional constructional techniques and equipments are intended to be used for repair or reinforcement of the existing structure, it is substantially impossible to deliver the equipment to a construction site or the existing structure itself obstructs a repair or reinforcement work.

BACKGROUND ART

FIG. 1A is a perspective view of an superstructure installed on a substructure of a aqueduct bridge, illustrating a state in which a channel having a U-shaped cross section is installed on a pier installed on the ground, and FIG. 1B and FIG. 1C are perspective views illustrating detailed examples of repair or reinforcement means and method of the aqueduct bridge shown in FIG. 1A.

A aqueduct bridge 100 consisting of an superstructure, such as a channel with a U-shaped cross-section, and a substructure, such as a pier, is generally constructed in a manner that the aqueduct bridge 100 is divided into several segments 10 supported by a pier 20 according to its length, so that the superstructure formed at a predetermined height from the ground surface. The pier is a kind of a columnar structure, and its lower portion is embedded a predetermined depth into the ground. In general, a pier foundation is formed at the lower edge of the embedded columnar structure. Accordingly, a load of the superstructure, e.g., the channel, is transferred to the ground via the substructure, e.g., the pier and its foundation, thereby securely supporting the superstructure by the substructure. Here, since an upper surface of the pier or a coping portion 30 is a structurally weak portion, the durability thereof is deteriorated over time, resulting in occurrence of cracks. If the cracks become severe, the upper surface of the pier or the coping portion 30 is eventually damaged so that the superstructure supported thereby may settle. If a timely repair or reinforcement work is not carried out, safety of the superstructure is severely endangered. There have been proposed several conventional methods for repair or reinforcement of such an upper surface of piers or a coping portion, as follows: 1) after an superstructure supported by piers, is first removed, an upper surface of the pier or a coping portion is repaired, and then an superstructure is reconstructed; 2) as shown in FIG. 1B, a reinforcing steel member 40, such as a separate H-beam or a steel plate, is additionally installed to the pier; and 3) as shown in FIG. 1C, additional piers are installed in the vicinity of the existing piers. However, the conventional problems have several problems. For example, the first proposed method is effective only in a case where the superstructure is too severely damaged to repair. Above all, this method has a problem that a considerable cost is required in removing and reconstructing the superstructure. According to the second method, even if the reinforcing steel member 40 is additionally installed, a reinforcing capability thereof deteriorates over time, so that the upper surface of the pier or the coping portion may be further severely damaged. The third method has problems that it is not easy to establish a construction road for transporting equipments required in additionally constructing a pier and to acquire an additional construction site, and a considerable cost is required for such additional construction work. Also, in a case where a bearing force of soil of the foundation ground is not sufficiently strong, the pier foundation cannot bear the load applied from the superstructure, resulting in settlement of the pier foundation due to the load transferred from the superstructure. Such settlement is generally in the form of differential settlement, which may seriously adversely affect safety of the superstructure. However, conventional repair or reinforcement methods of preventing the pier foundation from settlement have not yet been found to be satisfactory. One conventional solution to the settlement problem was that the superstructure was entirely or partially removed, a pier, including a new pier foundation, was constructed and a superstructure was then reconstructed.

FIG. 2A is a side view of an aqueduct bridge having a box-shaped superstructure 10 having a U-shaped cross section, installed on a pier 20 by a bearing 60. The superstructure 10, channel, is installed at a predetermined height above the pier 20. Because the pier 20 and the superstructure 10 is supported by a bearing force of soil of foundation ground, If the force of soil with respect to the ground is insufficient, the pier or the pier foundation settles and the superstructure also unavoidably settles. According to concentration of a load to connecting portion of a superstructure, eventually, as shown in FIG. 2B, the bearing 60 may be damaged or the upper surface of the pier (or the coping portion) may be damaged. Also, as the bearing 60 degrades, the pier coping portion is damaged, so that the superstructure may differentially settle, thereby the safety of the superstructure or the substructure is endangered. To overcome such a safety problem, by way of prevention of collapse of the superstructure or leakage of water flowing through the channel, one possible conventional way was to remove the superstructure itself before reconstructing a new pier. In order to repair or reinforce the coping portion of the pier or the bearing it is necessary to lift the superstructure. Here, even if the coping portion of the pier or the bearing is replaced after simply lifting the superstructure, an additional repair or reinforcement work is required unless a sufficient bearing force of soil of the foundation ground is acquired. Thus, when there is settlement in the pier foundation of the existing structure, a separate superstructure supporting means should be provided. In this case, the superstructure needs to be additionally supported by installing a new pier next to the pier on the ground. However, due to construction site conditions, a necessity of establishing a construction road for equipment delivery, various constructional difficulties resulting from the use of large-scale equipment, an increase in the construction cost, using the existing large-scale equipments and special-purpose equipments was very restricted.

DISCLOSURE OF INVENTION

Technical Problem

The present invention provides a repair or reinforcement system and method of an existing structure, in which structure supporting means used for a foundation work, such as a precast concrete pile or a steel pile, can be efficiently utilized. Also, the p resent invention provides a repair or reinforcement system and method of an existing structure, by which the existing structure can be repaired or reinforced without using any large-scale equipments and special equipments and/or techniques depending on construction site. The present invention provides a repair or reinforcement system and method of an existing structure, by which a repair and reinforcement work can be performed in a noiseless, vibration-free manner without causing any harmful environmental impact. Further, the present invention provides a repair or reinforcement system and method of an existing structure, by which a repair or reinforcement work can be efficiently performed without being obstructed by the existing structure which may obstruct the repair or reinforcement work due to its location, for instance, a height limit problem, or its installation pattern.

Technical Solution

To achieve the above objects, in an aspect of the present invention, structure supporting means, such as a steel pile, is pressed fit into the ground under an existing structure to reach a predetermined rigid bearing layer, and the existing structure is lifted by the structure supporting means. In such a state, a target portion for repair or reinforcement can be repaired or reinforced. At the same time, an additional bearing force of soil of foundation ground can be acquired by the structure supporting means which has been pressed fit.

In another aspect of the present invention, the existing structure itself or a separate frame assembly can be used as pressure bearing body for a press-fit of the structure supporting means. When a pressure based on pressurizing means is applied to the pressure bearing body, the structure supporting means is pressed fit into the ground by a reaction force of the pressure bearing body. Thus, even if the existing structure has been preformed, the structure supporting means can be easily pressed fit irrespective of the construction site of a foundation structure without a necessity of delivering separate large-scale equipment.

Further, since the structure supporting means is pressed fit into the ground, a noiseless, vibration-free construction work is possible without causing any harmful environmental impact.

Also, since joint-constructable means formed of steel, glass fiber composite material or the like is used as the structure supporting means, the structure supporting means can be easily pressed fit to reach a predetermined rigid bearing layer without being affected by the specification, including a diameter, a length and so on, of the structure supporting means, thereby efficiently repairing or reinforcing the existing structure.

DESCRIPTION OF DRAWINGS

FIG. 4A is a side view of a conventional existing structure before repair or reinforcement is performed, FIGS. 4B and 4C are a plan view and a front view illustrating a state in which a repair or reinforcement work is completed in a state in which the existing structure is lifted, in a case of using the existing structure itself as a pressure bearing body.

BEST MODE

FIGS. 3A through 3E illustrate sequential processing steps of performing a repair or reinforcement work on an existing structure by pressing fit structure supporting means, such as a steel pile, into the ground by the repair or reinforcement system according to the present invention.

Figure 1A:
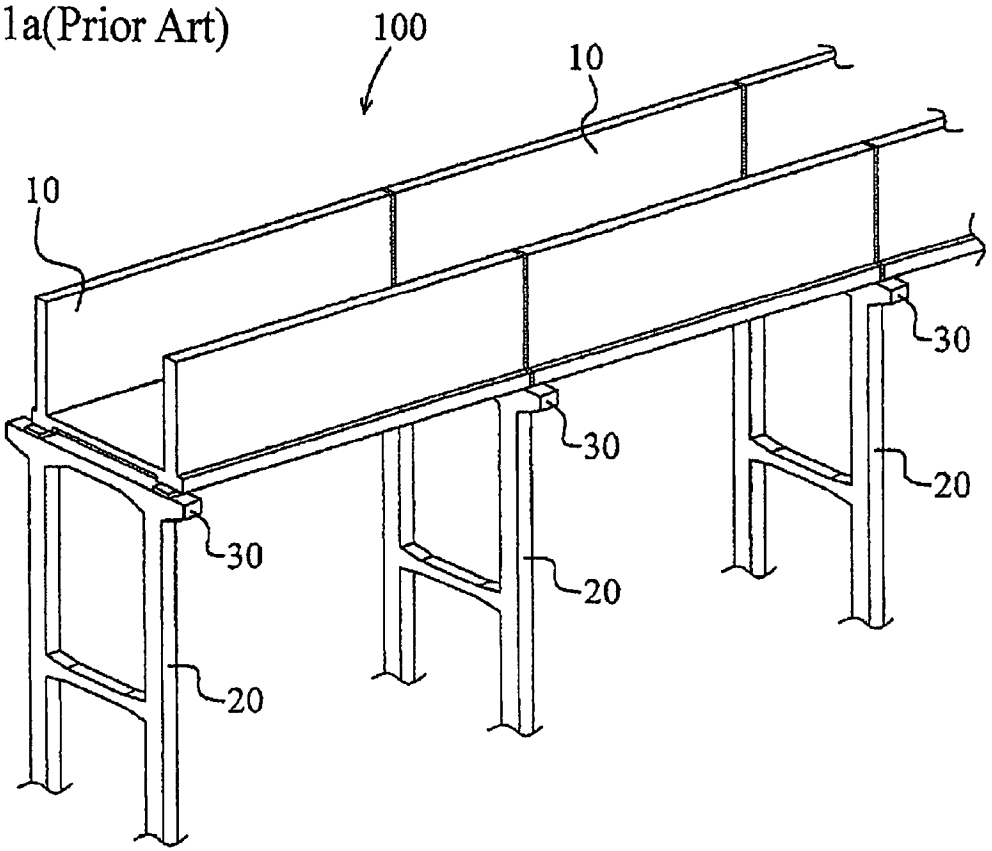
Fig. 1a(Prior Art)
FIG. 1A is a perspective view illustrating an superstructure installed on a substructure forming a aqueduct bridge, that is, a channel having a U-shaped cross section.
Figure 1B:
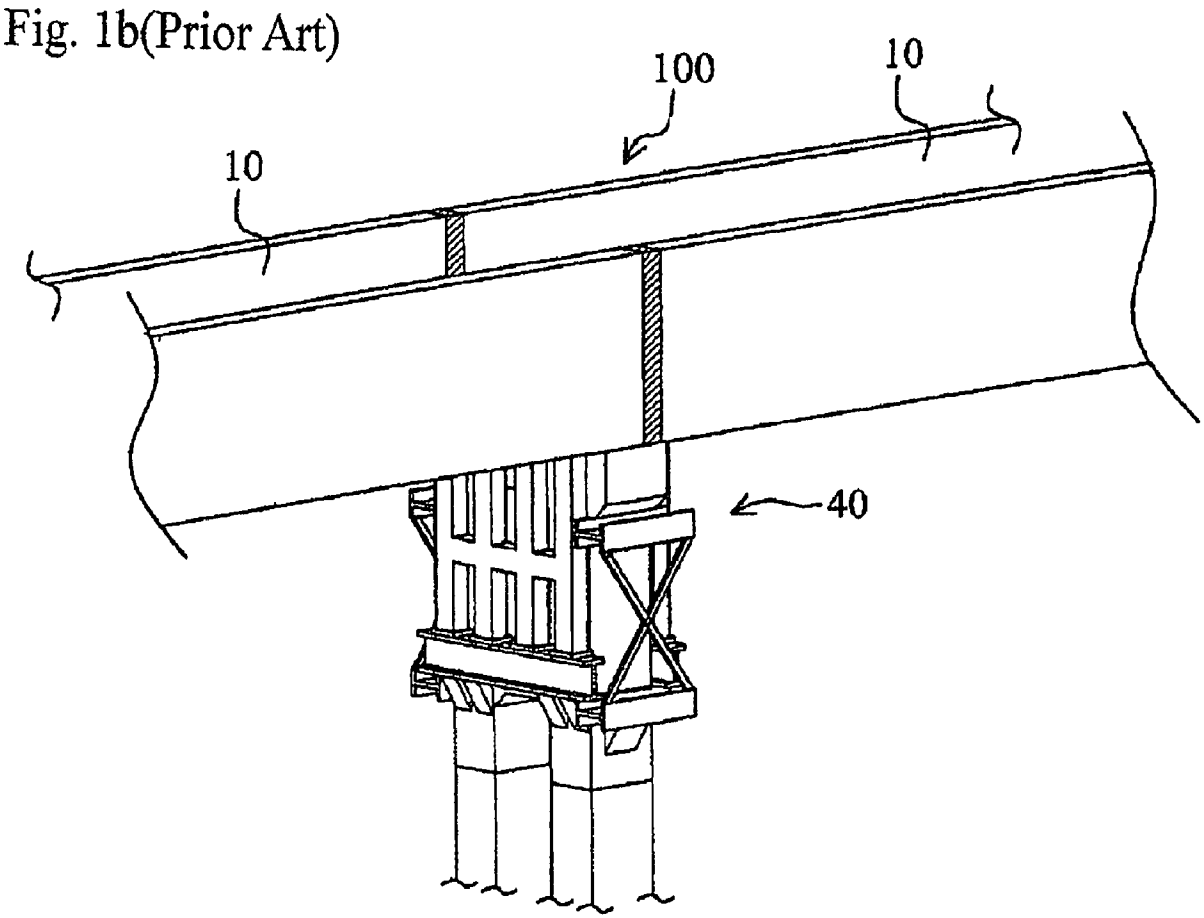
Fig. 1b(Prior Art)
FIG. 1B is a perspective view illustrating a state in which a reinforcing steel member is installed to a pier for repair or reinforcement of the bridge shown in FIG. 1A.
Figure 1C:
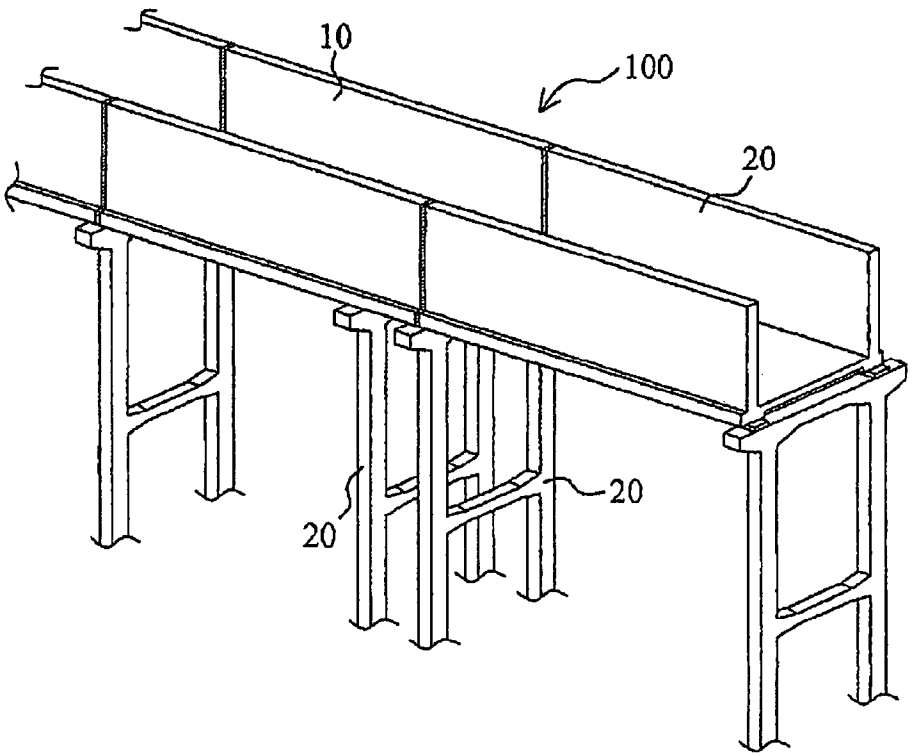
Fig. 1c(Prior Art)
FIG. 1C is a perspective view illustrating a state in which a new pier is additionally installed next to the pier for supporting the bridge shown in FIG. 1A.
Figure 2B:
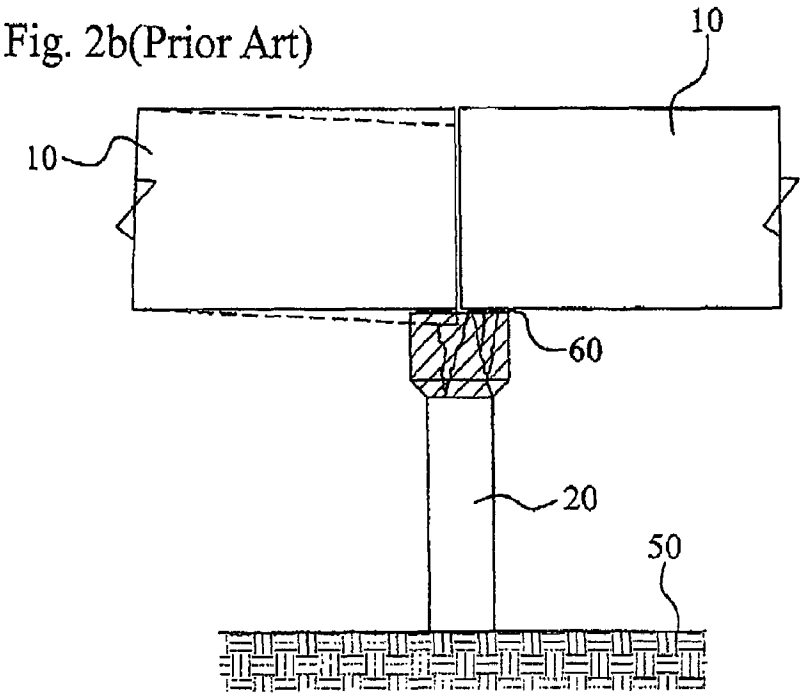
Fig. 2b(Prior Art)
FIG. 2B illustrates a state in which a coping portion of a pier is damaged.
Figure 2A:
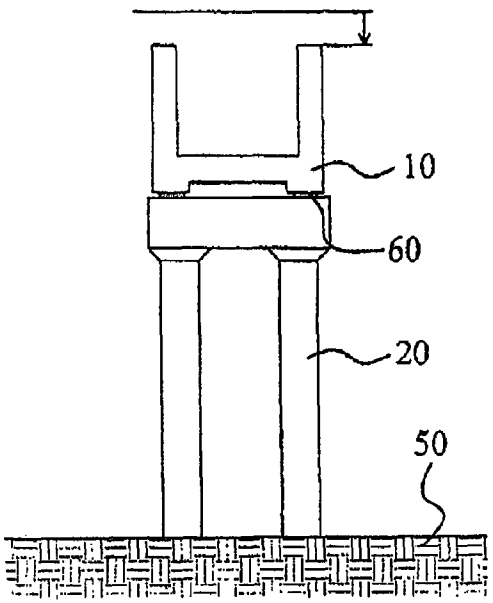
Fig. 2a(Prior Art)
FIG. 2A illustrates a state in which the superstructure installed on the pier settles.
Figures 3A, 3B, 3C:
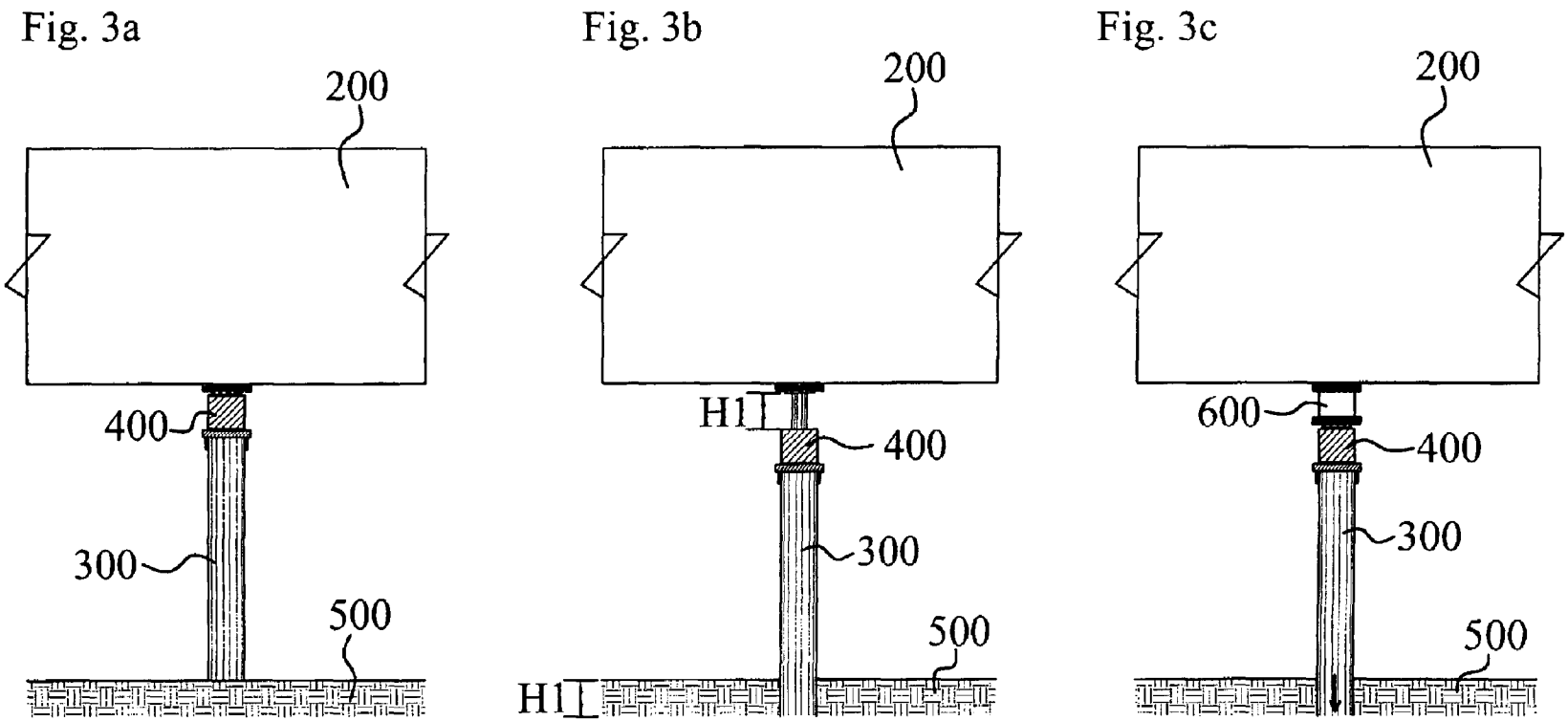
FIGS. 3A, 3B, 3C, 3D and 3E are diagrams sequentially illustrating a repair or reinforcement process of an existing structure using a reaction force of pressurizing means, the process performed by the repair or reinforcement system according to the present invention.

FIG. 3A illustrates a state in which structure supporting means 300 such as a steel pile is installed on a ground 500 with respect to a pressure bearing body 200, such as the existing structure itself or a separate frame assembly, and pressurizing means 400, such as a hydraulic jack, is installed between the pressure bearing body 200 and the structure supporting means 300.

The pressure bearing body 200 may be the existing structure itself, or a separate frame assembly 700 including a bearing member made of an H-beam, a support member and an anchor member, which will later be described. The pressure bearing body 200 bears a pressure exerted by pressurizing means 400 to be described below, and allows a reaction force of the pressurizing means 400 to be applied to the structure supporting means 300 connected thereto, so that the structure supporting means can be pressed fit into the ground 500 in a noiseless, vibration-free manner.

In a case where the pressure bearing body 200 is the existing structure itself, it bears a pressure exerted by the pressurizing means 400 by its dead weight, and a reaction force thereof is transferred to the structure supporting means 300. Otherwise, in a case where the existing structure itself cannot be used as the pressure bearing body 200, that is, where the existing structure is not suitable for bearing the pressure of the pressurizing means due to its constructional pattern, location or materials, a separate frame assembly 700 is installed to function as a pressure bearing body, as shown in FIG. 5C. The frame assembly 700 is preferably formed of a minimum number of elements to generate a predetermined reaction force based on the pressurizing means, thereby reducing the installation cost and facilitating a disassembling work thereof.

A common hydraulic jack or jack support can be used as the pressurizing means 400, and the kind, capacity and driving method thereof may vary according to construction site conditions or specification of the structure supporting means. The pressurizing means 400 eventually exerts a pressure for generating a reaction force applied to the structure supporting means 300 to the pressure bearing body 300. In a case of using the hydraulic jack or jack support as the pressurizing means 400, a separate pressure bearing plate 600 (or a filler plate) is installed thereon so that a constant pressure is applied to the pressure bearing body 200. A head reinforcing plate is installed on a lower end of the pressurizing means 400, which contacts an upper end of the structure supporting means 300. Thus, a local damage of the structure supporting means 300 can be prevented by the reaction force of the pressurizing means 400, and the reaction force can be uniformly transferred to the structure supporting means 300.

Any member having a material and strength that can be pressed fit into the ground by the pressurizing means, such as a steel pile, a PHC pile or a carbon composite fiber member, can be used as the structure supporting means 300, and is selectively used in consideration of construction site conditions, for example, according whether the construction site is a marine, land or saline area, and constructional surroundings. The structure supporting means 300 is pressed fit into the ground 500 by the pressurizing means 400, eventually serving to support and reinforce the existing structure. However, by virtue of the repair or reinforcement purposes of the existing structure, since there may be a limitation in the construction space due to the existing structure, lightweight, easily joint-constructable means is preferably used as the structure supporting means 300. Specifically, joint-constructable means made of a steel pile or a glass fiber composite material can be used.

Properties of the ground 500, into which the structure supporting means is pressed fit, are determined by the soil quality of a place where the existing structure is located. In the present invention, when the ground 500 has properties allowing the structure supporting means to be pressed fit and includes a predetermined rigid bearing layer L, such as a gravel layer or a base rock layer, in the ground 500, by which the structure supporting means can have a predetermined bearing force of soil, the structure supporting means can effectively function.

FIG. 3B illustrates a state in which a hydraulic jack as the pressurizing means 400 is driven so that a cylinder of the hydraulic jack is elongated a predetermined length H1 to thus exert a predetermined pressure on the pressure bearing body 200, so that the structure supporting means 300 can be pressed fit into the ground 500 by an elongation length of the cylinder using the reaction force of the pressurizing means 400.

FIG. 3C illustrates a state in which, for a further press-fit of the structure supporting means 300, a pressure bearing plate 600 (or a filler plate) is installed on the pressurizing means, in a state in which the cylinder of the hydraulic jack, i.e., the elongated pressurizing means 400, is restored into its original position.

Figure 3E:
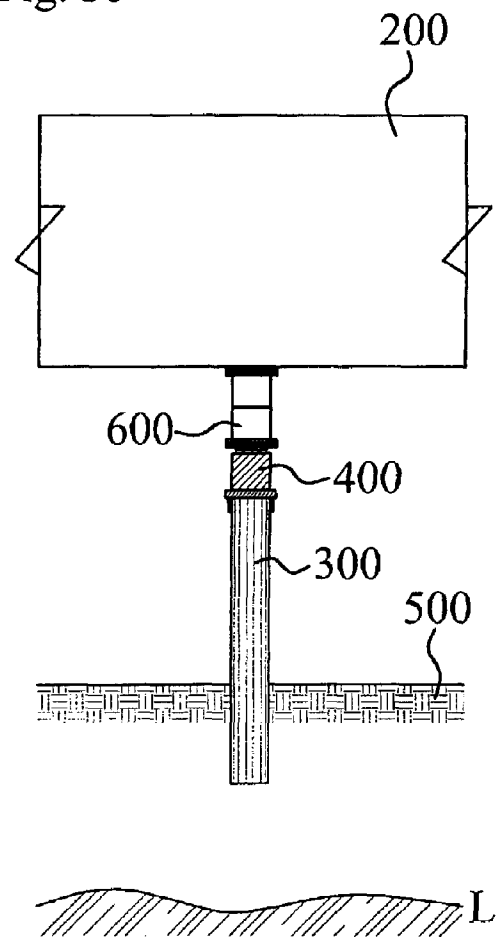
Figure 3D:
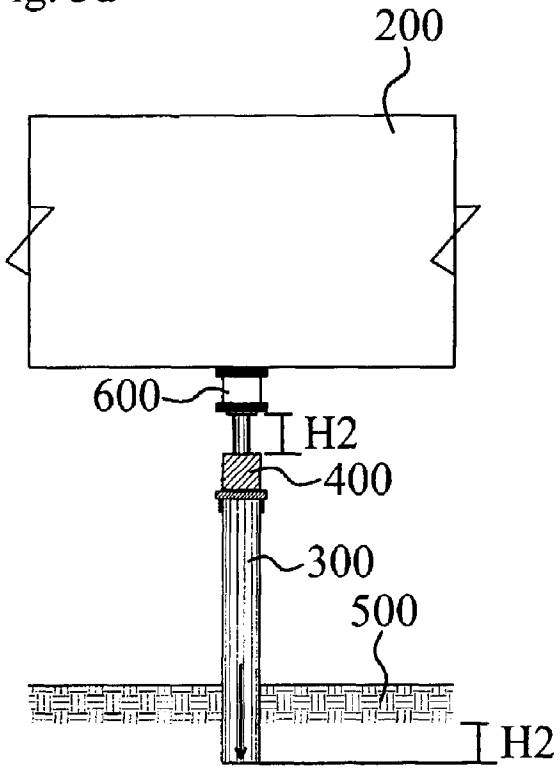

FIG. 3D illustrates an additionally press-fit state of the structure supporting means 300. In a state in which the pressure bearing plate 600 shown in FIG. 3C is pressed fit into the ground 500, the hydraulic jack as the pressurizing means 400 is driven again so that the cylinder of the hydraulic jack is elongated. Then, an additional pressure of the pressurizing means 400 is transferred to the pressure bearing body 200 through the pressure bearing plate 600 and the reaction force thereof is also transferred to the structure supporting means 300 through the pressure bearing plate 600. Thus, the structure supporting means 300 is additionally pressed fit into the ground 500 by a length H2 of a newly elongated cylinder of a hydraulic jack. A diameter, a height, and the like, of the pressure bearing plate 600 are determined in consideration of the maximum elongation length of the cylinder of the hydraulic jack as the pressurizing means 400, the capacity and size of the hydraulic jack. The pressure bearing plate 600 can be a remaining part after fabricating a structure supporting pile can be used as, or may be separately fabricated.

FIG. 3E illustrates a state in which the elongated cylinder of the hydraulic jack is restored into its original position in a state in which the length of the pressure bearing plate 600 is continuously increased for a further press-fit of the structure supporting means 300 a predetermined length into the ground 500. The structure supporting means can be continuously pressed fit a predetermined depth down into the ground just by continuously increasing the length of the pressure bearing plate 600, without changing the specification of the hydraulic jack. If the length of the pressure bearing plate 600 is continuously increased, the press-fit length of the structure supporting means is increased until the structure supporting means eventually reaches a pre-determined rigid bearing layer, that is, a base rock layer L. In such a state, the structure supporting means cannot be further pressed fit into the ground just by elongation of the cylinder of the hydraulic jack cannot further, which is due to the existence of the pre-determined rigid bearing layer L. From this time, further elongating the cylinder of the hydraulic jack allows the structure supporting means 300 to lift the subsided existing structure, that is, a pressure bearing body. After the existing structure is lifted until the last settlement is recovered, the existing structure and the structure supporting means are dynamically balanced. At this time, a repair or reinforcement work may be performed on a portion of the existing structure to be subjected to the repair or reinforcement work. The structure supporting means 300 that has been pressed fit into the ground 500, the pressurizing means 400 and the pressure bearing plate 600, can be installed or removed at any time until repair or reinforcement of the pressure bearing body 200 constituting the existing structure or separate frame assembly is completed.

The best mode for carrying out the present invention will now be described with reference to FIGS. 4 and 5.

INSTALLATION EXAMPLE 1

Construction of a Subject Portion for Repair or Reinforcement Using Existing Structure as Pressure Bearing Body FIGS. 4A, 4B and 4C are a side view of an existing structure before being lifted, a plan view illustrating a state in which an superstructure of an existing structure settled by structure supporting means is lifted by a repair or reinforcement system according to the present invention using a reaction force of pressurizing means.

In other words, after structure supporting means 300, e.g., a joint-constructable steel pile, etc., is installed at a place a predetermined distance spaced apart from the pier 20, pressurizing means 400*a*, 400*b* are installed on the structure supporting means 300 and a pressure bearing plate 600 is subsequently installed, so that the structure supporting means 300 can be pressed fit into the ground in a noiseless, vibration-free manner to reach a predetermined rigid bearing layer L, e.g., a bearing layer capable of acquiring an allowable bearing force of soil. If a lower leading edge of the structure supporting means 300 is pressed fit down to the predetermined rigid bearing layer L, the settled superstructure can be lifted as the pressurizing means 400*a*, e.g., a hydraulic jack, is driven, thereby acquiring the final lifted height (H3 of FIG. 4C). Thereafter, the structure supporting means 300 makes the predetermined rigid bearing layer bear a load of the superstructure. Thus, no further settlement or sinking occurs to the superstructure. In Example 1, the existing structure itself, specifically a channel as the superstructure, is used as the pressure bearing body 200 on which a pressure of the pressurizing means is exerted. Since the superstructure is installed on an open space, other construction works are relatively less obstructed, and a reaction force against the pressure of the pressurizing means can be acquired by a dead weight of the superstructure. In a case where the dead weight of the superstructure cannot be utilized, a separate pressure bearing body, that is, a frame assembly 700, is installed, which will be described below in Example 2.

In consideration of the length of the structure supporting means 300, a jack support can be used as the pressurizing means 400*b*, rather than using the hydraulic jack 400*a*. In other words, if the structure supporting means 300 has a length shorter than that required for being pressed fit until it reaches a predetermined rigid bearing layer, a plurality of pressure bearing plates 600 or several structure supporting means connected together can be used. The jack support 400*b* is elongated by a rotation handle 410*b*, if any. While the structure supporting means is pressed fit into the ground using a pressure originating from the elongated jack support 400*b* and a reaction force thereof, a predetermined bearing force of soil against the ground can be acquired.

Therefore, in a case where a joint-constructable steel pile is used as the structure supporting means 300, the hydraulic jack 400*a* or the jack support 400*b* can be used as the pressurizing means adjustably according to the length of the structure supporting means 300. After the superstructure is lifted, a bearing and a coping portion of a pier installed at a connecting portion of the superstructure are repaired or replaced while leaving the structure supporting means 300, the pressurizing means 400*a*, 400*b*, and the pressure bearing plate 600 intact. In a case where settlement of the superstructure is not caused by an insufficient bearing force of soil against the ground but is caused by simple defects of the coping portion of a pier and bearing, the superstructure is first lifted and then the coping portion of a pier and other defective portions are repaired or reinforced. Then, the structure supporting means, the pressurizing means and the pressure bearing plate may be disintegrated to be recycled. The installation position and number of the structure supporting means may adjustably vary on necessity, as shown in FIG. 4B illustrating about four structure supporting means are installed in the vicinity of the pier.

INSTALLATION EXAMPLE 2

Construction a Subject Portion for Repair or Reinforcement Using Separate Frame Assembly as Pressure Bearing Body Unlike in Example 1, if the existing structure itself is not able to be used as the pressure bearing body, a separate frame assembly 700 is installed in the vicinity of the subject portion in place of the pressure bearing body 200, the structure supporting means 300 is pressed fit into the ground 500 using a reaction force of the frame assembly 700 in the same manner as in the case of the pressurizing means 400. Here, the structure supporting means 300 is pressed fit into the ground 500 through penetration of an existing foundation structure 800, e.g., a concrete bottom plate or a concrete foundation. Then, the structure supporting means 300 which has been pressed fit to an ultimate depth is integrally formed with the foundation structure 800, thereby repairing or reinforcing the existing foundation structure having an insufficient bearing force of soil against the ground.

Figure 5B:
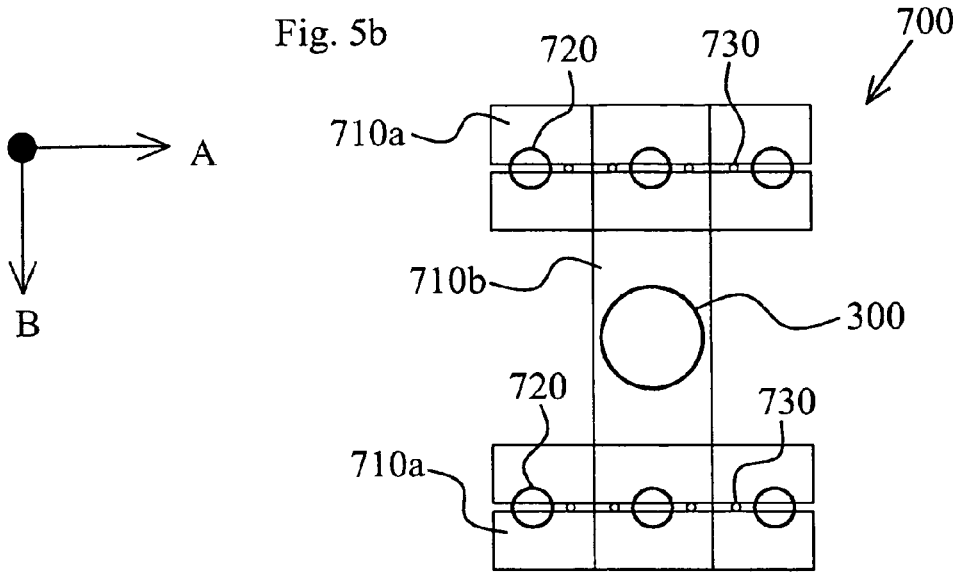
FIGS. 5A, 5B and 5C are a plan view, a side view and a front view illustrating a state in which in which a repair or reinforcement work is completed after the existing structure is lifted, in a case of using a separate frame assembly as a pressure bearing body.
Figure 5A:
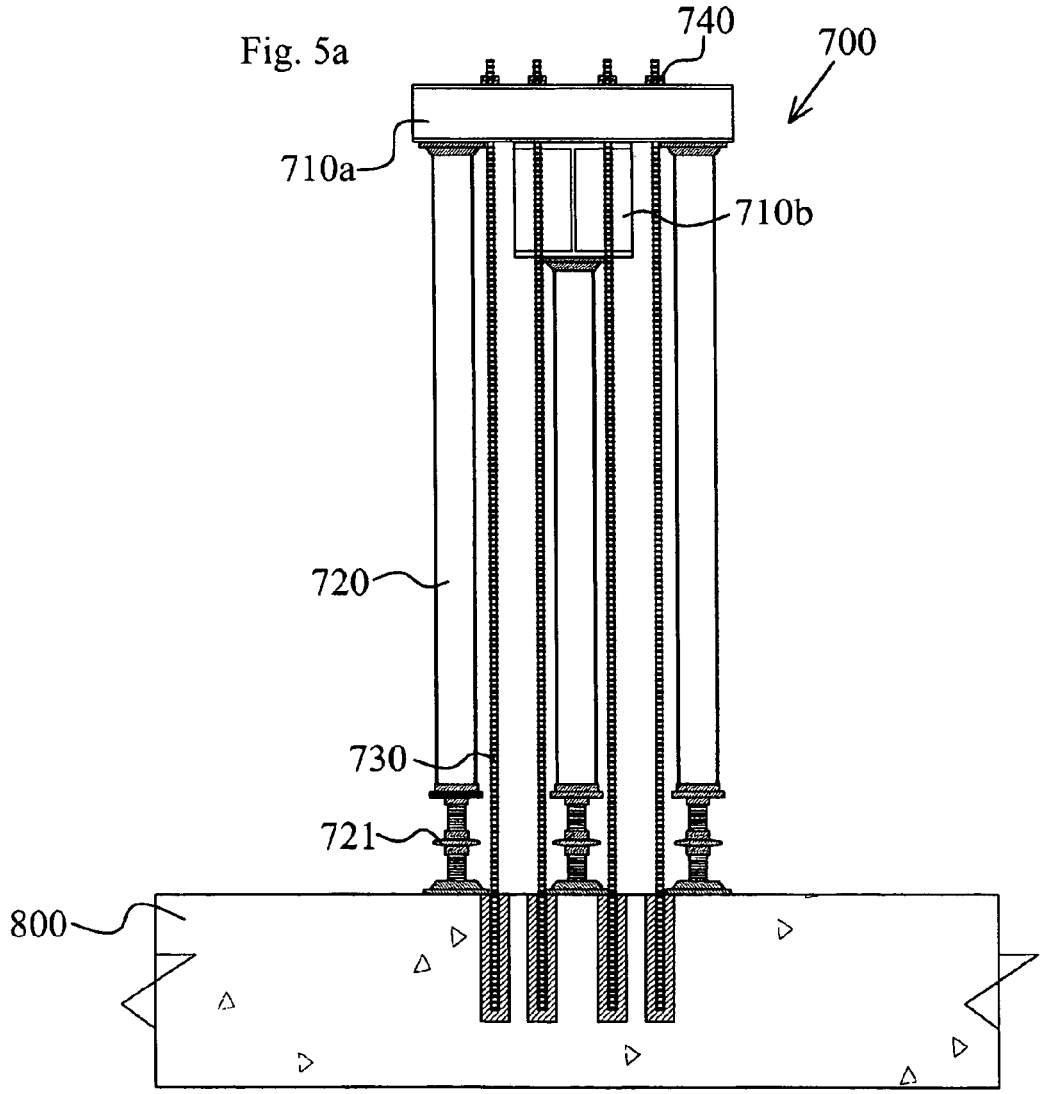
Figure 5C:
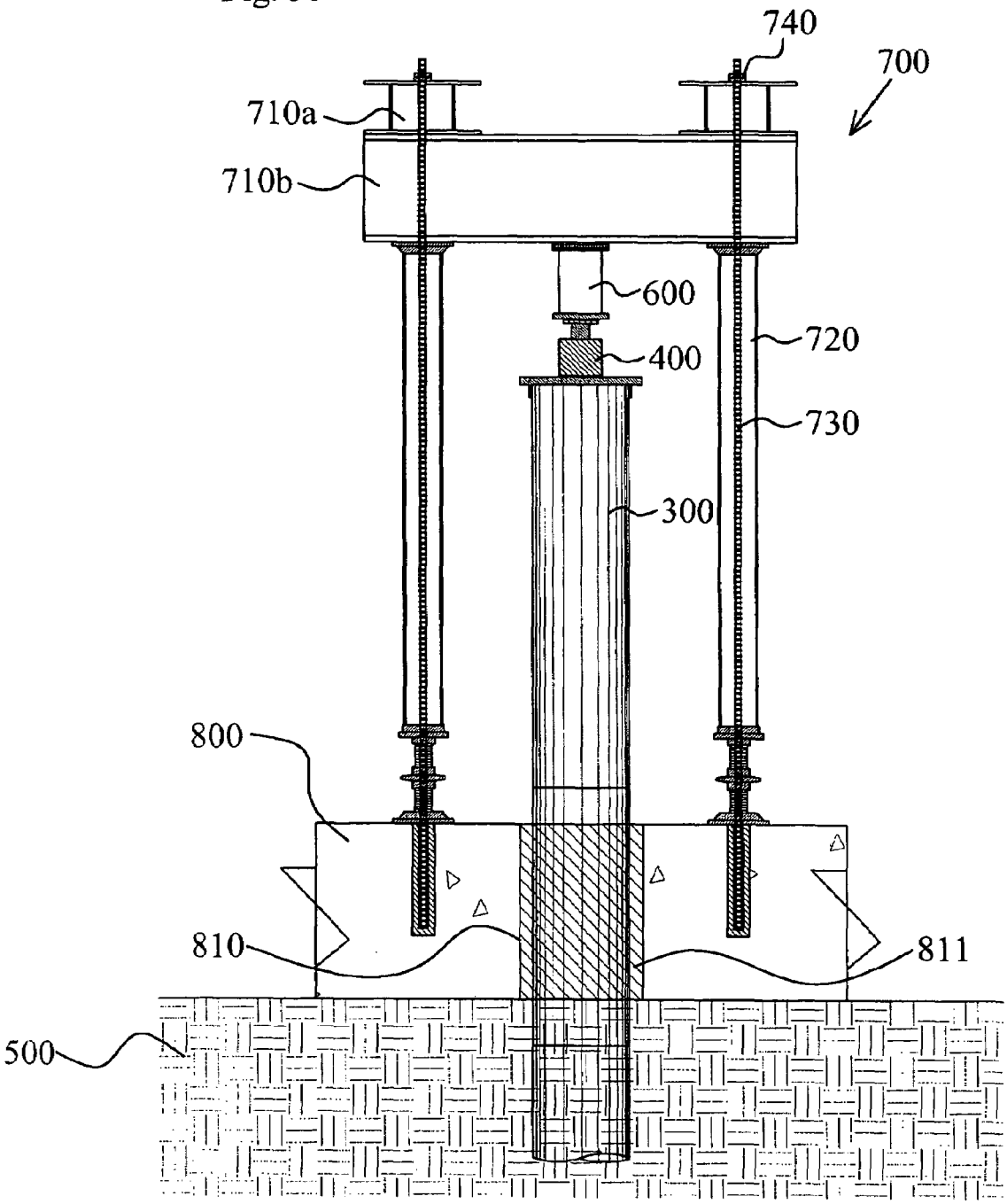

FIGS. 5A, 5B and 5C are a plan view, a side view and a front view illustrating a state in which in a case of using a separate frame assembly 700 as a pressure bearing body, structure supporting means 300 is pressed fit into an existing foundation structure 800 through a hole 810 previously drilled in the foundation structure 800, a hydraulic jack as a pressurizing means 400 is installed on the structure supporting means 300, the structure supporting means 300 is pressed fit into the ground 500 under the foundation structure 800 through the drilled hole 810 as a cylinder of the hydraulic jack is elongated.

The pressure bearing body 700 is a frame assembly installed in the vicinity of the drilled hole of the existing foundation structure 800. If an existing foundation structure is preformed, it is quite difficult to construct the structure supporting means 300 by a vertical press-fit due to a height limit of the foundation structure. Above all, in a case where the foundation structure has a structural problem to be used as a pressure bearing body, it is necessary to install a pressure bearing body, that is, the frame assembly 700 of the present invention. In particular, when a concrete or steel pile is inadvertently excluded in a completely constructed building structure, which is different from the original design in which the concrete or steel pile was supposed to be supported by a predetermined rigid bearing layer located under the foundation structure, several problems are presented. However, conventionally, there have been no conventional solutions to equipment delivery for additional construction of the steel pile, constructional difficulties due to the completely constructed existing structure, and so on. On the other hand, according to the present invention, a necessary steel pile is easily installed on a lower portion of a foundation structure, and the installed steel pile is incorporated into the foundation structure, followed by a finishing step, thereby an additional bearing force of the foundation ground can be acquired.

The frame assembly 700 as the pressure bearing body will now be described in detail. The frame assembly 700 includes bearing members 710*a*, 710*b* spaced a pre-determined distance apart from an existing pier foundation or a foundation structure and bearing a pressure based on pressurizing means 400; support members 720 each having one end supported on the bearing member and the other end supported on the existing foundation structure; and anchor members 730 formed between each of the support members 720, each having one end fixed on the existing foundation or a bottom plate structure and the other end fixed on the bearing member.

As shown in FIG. 5A, the bearing members 710*a*, 710*b* are positioned at a pre-determined height from an existing foundation structure 800 and supported by the support members 720. An H-BEAM strong enough to acquire a reaction force based on a hydraulic jack, the H-beam being capable of pressing fit the structure supporting means into the ground located under the foundation structure, can be used as the bearing members. Another structural member can also be used as the bearing embers. The bearing members 710*a* spaced in a horizontal direction indicated by an arrow A may be installed.

An H-beam as the bearing member 710*b* is installed across and between the two horizontally spaced bearing members in a vertical direction indicated by an arrow B, so that it bears a pressure applied from the pressurizing means 400 installed on the structure supporting means 300.

The bearing members 710*a*, 710*b*, such as H beams, installed across in the A and B directions, are fastened to the existing foundation structure 800 by means of each tension member. If the bearing members 710*a*, 710*b* are pressurized by an upward pressure produced as the pressurizing means 400, such as a hydraulic jack, installed on the structure supporting means 300, is elongated, the bearing members 710*a*, 710*b* tend to restrained by the pressure. However, if the bearing members 710*a*, 710*b* are not restrained, a reaction force cannot be exerted to the structure supporting means 300. Thus, there is a need to restrain the bearing members 710*a*, 710*b*. In the present invention, as such restraining means, the lower end of the bearing member 710*a* installed in the A direction is fastened to the existing foundation structure 800 using an anchor member 730 as the tension member, for example, a steel bar, reinforcing steel or a steel strand, and the upper end thereof is fixed to the bearing member 710*a* by an anchorage nut 740. In other words, a hole large enough to allow the anchor member 730 to be injected thereinto is previously drilled on the foundation structure, and the anchor member 730 is inserted into the hole, followed by filling a filler material such as mortar to be fixed. In such a state, an upper end of the anchor member 730 upwardly penetrates through the bearing member 710*a* and the anchorage nut 740 is fastened on the upper end of the bearing member 710*a*. Then, the bearing member 710*a* is tightly fastened to the existing pier foundation or the foundation structure by the anchor member 730 and the anchor member 730 serves as a tension member. At this time, a plurality of jack supports 721 are installed under the two bearing members 710*a* spaced in the A direction, and the overall length of the bearing members 710*a* is efficiently adjusted by means of a rotation handle formed in each jack support 721.

As shown in FIGS. 5A and 5B, in a state in which the bearing members 710*a*, 710*b*, the support members 720 and the anchor members 730 are installed, the pressure bearing plate 600, the pressurizing means 400 and the structure supporting means 300 are installed under a central portion of the bearing member 710*b* installed in the B direction. As shown in the plan view and the front view, one end of the structure supporting means 300 is pressed fit into the existing foundation structure 800 having a drilled hole 810, and the pressurizing means 400, e.g., a hydraulic jack, is installed thereon, and the hydraulic jack is elongated, so that the structure supporting means 300 is pressed fit by an elongation length of the hydraulic jack into the ground 500 located under the existing pier foundation or the foundation structure 800 in a noiseless, vibration-free manner. Then, in order to press fit the structure supporting means 300 to reach a predetermined rigid bearing layer, the pressure bearing plate 600 is installed on the hydraulic jack as the pressurizing means 400. In such a state, the hydraulic jack is continuously driven so that the structure supporting means 300 is finally pressed fit to reach the predetermined rigid bearing layer.

As to the structure supporting means 300, if the length thereof exceeds a pre-determined level, it is difficult to deliver the same to a construction site due to an installation location of a frame assembly or a height limit with respect to the structure supporting means 300. To address the difficulty, while reducing connected joints by acquiring as the longest structure supporting means as possible, the structure supporting means are interconnected to be pressed fit into the ground.

INDUSTRIAL APPLICABILITY

According to the present invention, since structure supporting means is constructed using a reaction force of pressurizing means such as a hydraulic jack or a jack support, a noiseless, vibration-free construction work is possible, thereby easily repairing and reinforcing an existing structure without causing any harmful environmental impact. Also, since constructional difficulties such as a necessity of delivering separate large-scale equipments for constructing the structure supporting means are solved, a repair or reinforcement work of the structure supporting means can be performed irrespective of the construction site. When structure supporting means exists as a permanent structure, repair or reinforcement effects of the existing structure can be markedly enhanced. Also, according to the present invention, joint-constructable means is used as the structure supporting means. Thus, in a case where there is a need for a joint-construction of structure supporting means made of different materials like in a case of land and marine structures, advanced girders developed after constructing the existing structure, or more efficient structure supporting means, can be utilized, thereby further enhancing the repair or reinforcement effect of the existing structure. The repair or reinforcement system according to the present invention can also be advantageously used as a field loading test apparatus for testing a bearing power limit of the ground.

The present invention encompasses structure supporting means, pressurizing means and a pressuring bearing body, which are technical features of the present invention, and it is, of course, possible to carry out a technique comprising pressing fit the structure supporting means into the ground using a reaction force of the pressurizing means within the technical scope of the present invention.

The invention claimed is:

1. A repair or reinforcement system of an existing structure using a reaction force of pressurizing means, comprising:

a ground including an existing foundation structure having a hole;

a pressure bearing body separately installed in the vicinity of a target portion for repair or reinforcement of the existing structure or being the existing structure itself;

structure supporting means for supporting the existing structure between the ground and the pressure bearing body;

pressurizing means for exerting an artificial pressure on the pressure bearing body in a state in which one end thereof is supported on an upper end of the structure supporting means, to press fit the structure supporting means into the ground using a reaction force generated in a direction opposite to a direction in which the pressure is applied; and wherein the separately installed pressure bearing body is a frame assembly, comprising:

bearing members installed a predetermined distance above the existing foundation structure and bearing the pressure of the pressurizing means;

support members each having one end supported to the bearing member and the other end supported to the existing foundation structure; and anchor members each having one end fixed to the existing foundation structure and the other end fixed to the bearing member, the anchor members being formed between each of the support members.

2. The repair or reinforcement system of claim 1, wherein jack supporters are further installed between each of the support members and the existing foundation structure and are driven to allow the support members to apply a pressure to the bearing members upwardly as the support members are elongated, and the bearing members restrained to the existing foundation structure by the anchor members are tightly fixed to the existing foundation structure together with the support member by a reaction force of the jack supporters.

3. The repair or reinforcement system of claim 1, wherein the anchor members are fixed to the bearing members such that one end of each of the anchor members is inserted into a hole for the anchor member in the existing foundation structure, followed by filling a filler material to be fixed, and the other end of the anchor member upwardly penetrates through the bearing member to be fastened by an anchorage nut.

4. The repair or reinforcement system of claim 1, wherein the pressurizing means comprises a hydraulic jack or a jack support, and the structure supporting means is continuously pressed fit into the ground by a predetermined length by inserting a pressure bearing plate into the upper end of the pressurizing means and continuously driving the pressurizing means.

5. A repair or reinforcement method of an existing structure using a reaction force of pressurizing means, comprising:

installing a frame assembly in the vicinity of the existing structure;

forming a hole in an existing foundation structure contacting a ground and inserting a structure supporting means into the hole, the structure supporting means having an upper portion spaced a predetermined distance from the frame assembly;

installing pressurizing means at a space formed between the upper portion of the structure supporting means and the existing structure, and driving the pressurizing means to apply a reaction force generated by pressurizing the existing structure by elongation of the pressurizing means to allow the structure supporting means to be pressed fit into the ground;

integrally forming the structure supporting means with the existing structure and completing a necessary repair or reinforcement work when the structure supporting means is continuously pressed fit into the ground to a predetermined depth so as to support the existing structure, the frame assembly being a pressure bearing body of generating a reaction force based on the pressurizing means; and wherein the frame assembly comprises bearing members installed a predetermined distance above the existing foundation structure and bearing the pressure of the pressurizing means, support members each having one end supported to the bearing member and the other end supported to the existing foundation structure, and anchor members each having one end fixed to the existing foundation structure and the other end fixed to the bearing member.

6. The repair or reinforcement method of claim 5, wherein jack supporters are further installed between each of the support members and the existing foundation structure and are driven to allow the support members to apply a pressure to the bearing members upwardly as the support members are elongated, and the bearing members restrained to the existing foundation structure by the anchor members are tightly fixed to the existing foundation structure together with the support member by a reaction force of the jack supporters.

7. The repair or reinforcement method of claim 5, wherein the anchor members are fixed to the bearing members such that one end of each of the anchor members is inserted into a hole for the anchor member in the existing foundation structure, followed by filling a filler material to be fixed, and the other end of the anchor member upwardly penetrates through the bearing member to be fastened by an anchorage nut.

8. The repair or reinforcement system of claim 5, wherein the pressurizing means comprises a hydraulic jack or a jack support, and the structure supporting means is continuously pressed fit into the ground by a predetermined length by inserting a pressure bearing plate into the upper end of the pressurizing means and continuously driving the pressurizing means.

* * * * *